US009188416B1

(12) United States Patent
Hash et al.

(10) Patent No.: US 9,188,416 B1
(45) Date of Patent: Nov. 17, 2015

(54) LEAD-FREE, CORROSION-RESISTANT PROJECTILES AND METHODS OF MANUFACTURE

(71) Applicant: Ervin Industries, Inc., Ann Arbor, MI (US)

(72) Inventors: Mark C. Hash, Chelsea, MI (US); Trent Pearson, Ann Arbor, MI (US)

(73) Assignee: Ervin Industries, Inc., Ann Arbor, MI (US)

( * ) Notice: Subject to any disclaimer, the term of this patent is extended or adjusted under 35 U.S.C. 154(b) by 0 days.

(21) Appl. No.: 14/737,884

(22) Filed: Jun. 12, 2015

Related U.S. Application Data

(63) Continuation-in-part of application No. 14/056,426, filed on Oct. 17, 2013, now Pat. No. 9,057,591.

(51) Int. Cl.

| | |
|---|---|
| ***F42B 12/74*** | (2006.01) |
| ***F42B 12/72*** | (2006.01) |
| *F42B 33/00* | (2006.01) |
| *F42B 8/14* | (2006.01) |

(52) U.S. Cl.
CPC . *F42B 12/72* (2013.01); *F42B 8/14* (2013.01); *F42B 33/00* (2013.01)

(58) Field of Classification Search
CPC ..... F42B 30/02; F42B 12/74; F42B 12/34; F42B 12/36; F42B 12/06; F42B 12/745; F42B 12/72; F42B 7/10; F42B 8/14
USPC ..... 102/501, 506, 439, 516, 517
See application file for complete search history.

(56) References Cited

U.S. PATENT DOCUMENTS

| | | | | |
|---|---|---|---|---|
| 6,457,417 | B1 * | 10/2002 | Beal | F42B 12/74 102/517 |
| 8,028,026 | B2 | 9/2011 | Jain et al. | |
| 2002/0156137 | A1 * | 10/2002 | Zhou | B01J 23/745 518/719 |
| 2003/0101891 | A1 | 6/2003 | Amick | |
| 2004/0129165 | A1 | 7/2004 | Cesaroni | |
| 2004/0216589 | A1 | 11/2004 | Amick | |
| 2006/0107863 | A1 | 5/2006 | Powers | |
| 2007/0000404 | A1 | 1/2007 | Eberhart | |
| 2007/0272112 | A1 * | 11/2007 | Nielson | C06B 27/00 102/473 |
| 2010/0071579 | A1 * | 3/2010 | Powers, Jr. | F42B 8/12 102/506 |
| 2010/0083861 | A1 * | 4/2010 | Joys | C22C 1/0425 102/506 |
| 2010/0175576 | A1 | 7/2010 | Weeks et al. | |
| 2011/0088537 | A1 | 4/2011 | Eberhart | |
| 2011/0162550 | A1 | 7/2011 | Hash et al. | |
| 2011/0185936 | A1 * | 8/2011 | Richardson | F42B 12/36 102/438 |

(Continued)

*Primary Examiner* — Samir Abdosh
*Assistant Examiner* — John D Cooper
(74) *Attorney, Agent, or Firm* — Dinsmore & Shohl LLP

(57) ABSTRACT

To produce lead-free projectiles, iron and copper are melted at a predetermined ratio and rapidly quenched to yield a fine-grained microstructure with uniformly distributed copper and iron phases. The iron-copper alloy may be made into a powder through atomization, with the iron-copper molten metal being dispersed using a rapidly moving gas, liquid stream, or via mechanical dispersion. The step of forming the bullet may include solid-state sintering of the atomized powder, including heating at a temperature below 1083° C., the melting point of copper. Alternatively, the step of shaping the mixture into a bullet-shaped form may include casting and/or uniaxially pressing the mixture into a mold. A ceramic powder may be added to the copper-iron mixture prior to forming to produce a frangible projectile. Chromium, including chromium from recycled stainless steel, may be added to increase corrosion resistance and/or reduce manufacturing cost.

20 Claims, 2 Drawing Sheets

(56) References Cited

U.S. PATENT DOCUMENTS

2012/0024184 A1* 2/2012 Hash ..... C22C 1/04
102/501

2012/0279412 A1 11/2012 Hash et al.

2012/0294751 A1* 11/2012 Joys ..... C22C 1/0425
419/66

* cited by examiner

LEAD-FREE, CORROSION-RESISTANT PROJECTILES AND METHODS OF MANUFACTURE

REFERENCE TO RELATED APPLICATION

This application is a continuation-in-part of U.S. patent application Ser. No. 14/056,426, filed Oct. 17, 2013, the entire content of which is incorporated herein by reference.

FIELD OF THE INVENTION

This invention relates generally to lead-free projectiles and, in particular, to method of making such projectiles from copper-iron alloys.

BACKGROUND OF THE INVENTION

As lead-based materials continue to be undesirable for ammunition and other applications due to their intrinsic toxicity, realistic economic substitutes will become more needed. Metallic-based solutions are preferable due to potential densities and performance requirements; toughness and/or frangibility. Traditional all-metal bullets are designed to either penetrate armors or maximize energy transfer on target via hollow-point and/or expanding technologies.

Copper offers the next-best material of choice based on its physical characteristics; density, toughness, and formability. Unfortunately, despite its relative abundance, the cost of copper, is up to five times the cost of lead and therefore limits its acceptance. Iron is notably less expensive but also less dense. Iron alone is not a practical solution due to its tendency to create sparks exiting the muzzle and on impact with steel targets. Iron alone can also potentially be classified as armor-piercing.

These two common metals can be combined as separate powders and formed using typical powder metallurgy methods but the degree of mixing, and therefore performance, is notably limited due to practical particle sizes. Mechanical alloying is also a viable approach but is less attractive due to the relative cost of this high energy, batch process.

SUMMARY OF THE INVENTION

This invention resides in methods of making lead-free projectiles and the bullets or projectiles produced thereby. In accordance with the method, an iron-copper alloy is produced by melting the metals together at a predetermined ratio of iron to copper. The alloy is rapidly quenching the alloy to produce a fine-grained microstructure with uniformly distributed copper and iron phases, and shaped into a bullet-shaped form.

To improve performance and reduce sparking, it is desirable to keep iron and/or copper phase size as small as practical. Accordingly, in preferred embodiments, iron and/or copper phase sizes are on the order of 50 microns or less in any dimension. More preferably, phase size is less than 40 or 30 microns, and in most preferred embodiments iron and/or copper phase size is 20 microns or less in any dimension. The iron-copper alloy may be made into a powder through atomization, with the iron-copper molten metal being dispersed using a rapidly moving gas, liquid stream, or via mechanical dispersion.

The step of forming the bullet may include solid-state sintering of the atomized powder, including heating at a temperature below 1083° C., the melting point of copper. Alternatively, the step of shaping the mixture into a bullet-shaped form may include casting and/or uniaxially pressing the mixture into a mold.

The ratio of iron to copper may be adjusted to achieve a desired density or production cost. In preferred embodiments, the ratio of iron to copper is 1:1 by weight. A ceramic powder may be added to the copper-iron mixture prior to forming to produce a frangible projectile. The method may further include the step of adding one or more of the following in powder form to enhance strength, toughness, density, or hardness: tungsten, bismuth, uranium (depleted), nickel, chromium, manganese, boron, and silicon.

Further embodiments of this invention are possible by adding chromium to the molten iron and copper alloy prior to rapid cooling. In general, chromium to iron weight ratios in the molten alloy ranging from 0 to 0.45 will form desired microstructures for making projectiles. The performance benefits of adding chromium are also quite appealing by enhancing the corrosion resistance of the iron phase in the final, rapidly-cooled microstructure. By adding chromium to the alloy as described above both muzzle and on-target sparking are also further reduced. A preferred embodiment employs the use of recycled stainless steel, including but not limited to, Types 410 and 430.

DETAILED DESCRIPTION OF INVENTION

Figure 1:
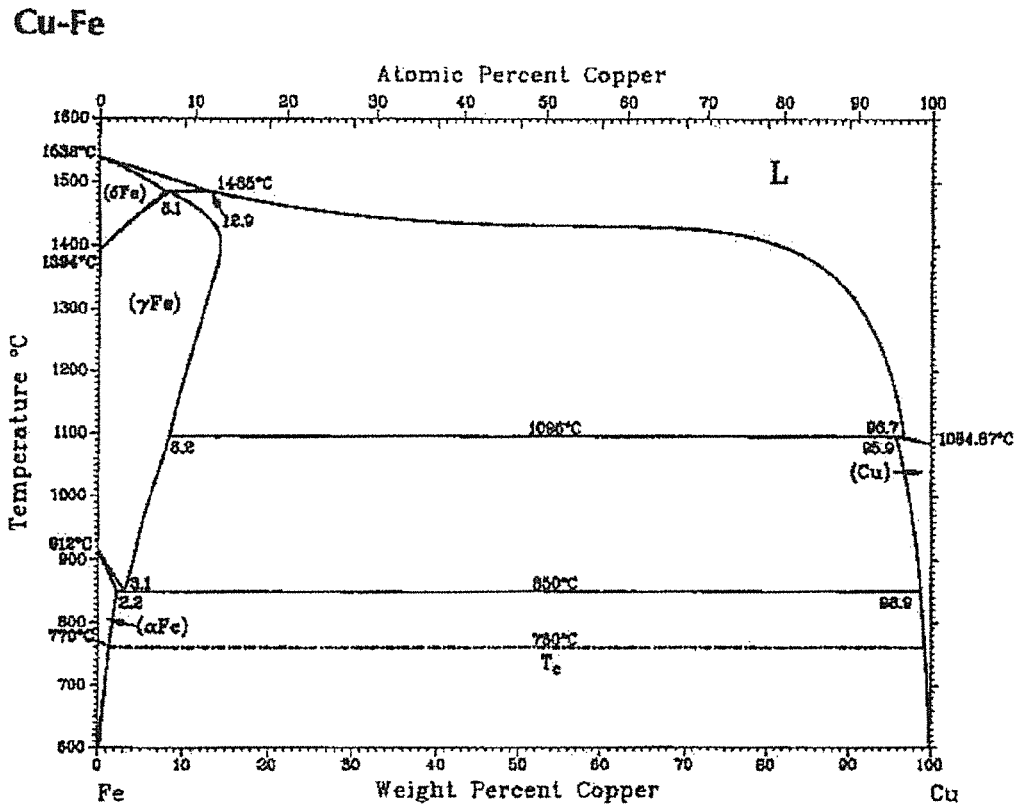
FIG. 1 is a lead-copper phase diagram.

The invention identifies a range of copper-iron alloys and the processing methods to produce lead-free alternative projectiles or bullets comprised of a homogeneous microstructure containing fine copper and iron phases. The iron-copper binary system is utilized to create a dense, low-cost projectile suitable for replacement of all lead-based bullets and other projectiles. The range of possible compositions allows material designers to select desired levels of density and cost.

Suitable powder atomizing techniques, wherein molten metal is dispersed into particles by rapidly moving gas or liquid stream or by mechanical processes, are employed to optimize the final phase distribution, maximizing mixing of the insoluble iron and copper phases. A rapid cooling or quench rate achieved with these atomization techniques, resulting in a homogeneous microstructure which is ideal for use in bullets and projectiles. The resulting uniform density throughout these parts lends to greater degrees of accuracy and consistency. Intimate mixtures of iron and copper also show negligible amounts of muzzle and/or target sparking, a common concern in use of iron-containing bullets.

Yielded powders can be readily made into projectiles using common powder metallurgy forming methods employing processing temperatures less than the melting temperature of copper, 1083° C. (1981° F.). This temperature limit is suggested to keep the phase distribution uniform as achieved from atomization; partial or complete re-melting will result in non-uniform microstructures and ultimately poorly performing ammunition components. Direct casting of projectiles from a fully molten alloy may also be possible if a sufficiently rapid cooling rate can be achieved uniformly throughout the thickness of the part.

The resulting projectiles can be engineered to be either frangible or non-frangible depending on intended use. Our issued U.S. Pat. No. 8,028,026, incorporated herein by reference in its entirety, details the design and manufacturing of lead-free frangible bullets wherein an appropriate ceramic powder is combined with the atomized metal powders prior to forming and sintering. The resulting bullet is tough enough to load and fire due to the sintered metal matrix but will still pulverize when it makes contact with a steel target or backstop. To produce a non-frangible bullet the bullet is formed using only the copper-iron powder and sintered into a dense, tough final product.

Other metallic alloying elements can be added to the base copper-iron alloy to enhance physical properties such as strength, toughness, density, and hardness. Almost any metallic alloying element that could be considered for this purpose will add cost. Accordingly, the application of these advanced alloys would certainly have to warrant and support the addition expense. Metallic elements most likely to be considered include tungsten, bismuth, uranium (depleted), nickel, chromium, manganese, boron, and silicon. In general these metals are readily available and have notable effects on physical properties that are pertinent to projectile designs.

Equilibrium phase diagrams are often used to design and engineer materials. These diagrams describe material "systems." For this invention the material system of interest is copper and iron, the phase diagram for which is presented in FIG. 1. When combining two (or more) metals in a given proportion there are three different possible outcomes. First the metals may mix or be soluble within one another without causing any changes in crystalline structure. This often occurs at the compositional extremes where there is only a small amount of a metal mixed with the base metal.

In some metallic systems the metals are completely soluble within each other regardless of relative amounts. The net result when working with these compositions is a single solid phase or material with a given crystalline structure at room temperature.

A phase is defined as an isolated volume of homogeneous material of a given composition and crystalline structure. Another possibility is the formation of an intermetallic material. In this invention, the metals being combined form a single solid phase or material just like soluble compositions but in this case the crystalline structure is different than the metals used to make it.

Metal systems can also be insoluble which results in a mixture of the two metals when cooled to room temperature. The metals in this case do not mix into one another nor create a new material. The copper-iron equilibrium phase diagram shown in FIG. 1 illustrates the limited solubility of these two metals at the two compositional extremes. Insoluble mixtures ranging from roughly 12-95 wt % copper will typically result in a two phase material; iron and copper. Compositions of interest are within this range to provide sufficient density for bullet or projectile applications and to achieve significant cost-reduction as compared to pure copper.

The theoretical density[2] of copper is 8.9 g/cm$^3$ whereas iron is 7.9 g/cm$^3$. A casted lead bullet has a density of ~11 g/cm$^3$. The alloy can be designed for the best combination of density and cost depending on the intended application. Higher copper content yields greater densities but also greater material cost whereas iron lessens these characteristics.

Figure 2:
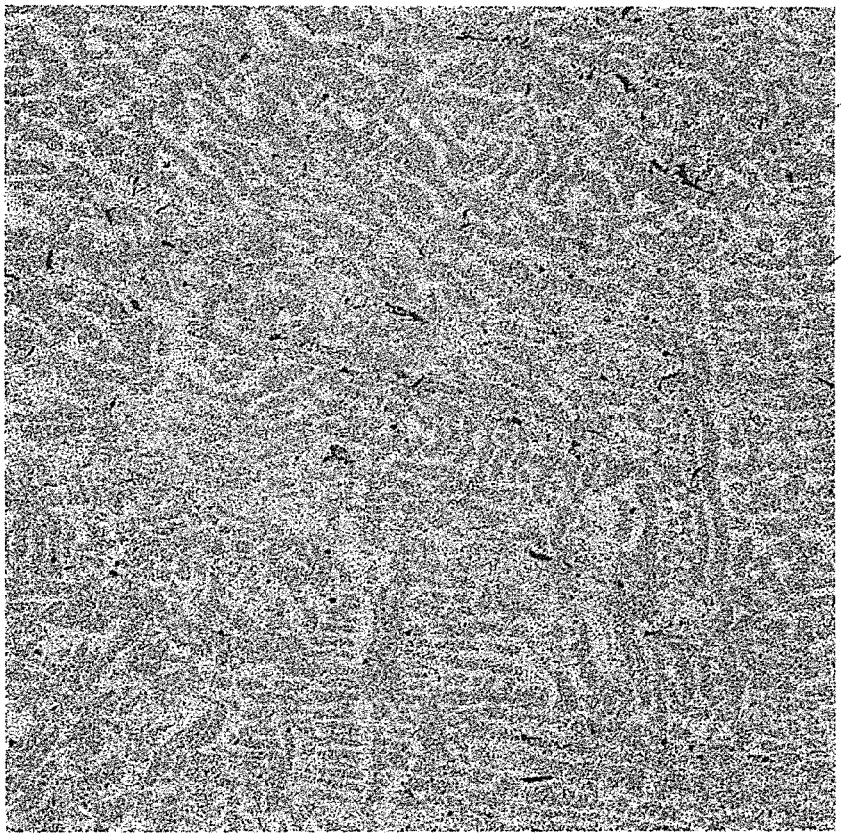
FIG. 2 is a scanning electron image showing three distinct phases in the cross-section of a test sample; namely, copper, iron, and porosity.

Our earlier work[1] using mixtures of pure copper and iron powders showed that a 1:1 mixture by weight of these metals results in a high-performance, cost-effective bullet. Accordingly this composition was chosen to test the viability of this invention. Copper and iron particles were hand-mixed, melted, and then cast into button. The molten metal was quenched aggressively in a water-cooled mold to achieve the desired homogeneous microstructure of fine copper and iron phases. As predicted by the equilibrium phase diagram the resulting phase assemblage showed both copper and iron phases uniformly distributed within a homogeneous microstructure as shown in FIG. 2.

The scanning electron image (FIG. 2) shows three distinct phases in the cross-section of the test sample; copper, iron, and porosity. The contrast seen in the secondary electron image is due to differences in atomic number wherein the copper is brighter than the iron. The darkest features are residual porosity in the cast part. As can be seen the microstructure contains similar amounts of copper and iron in any given part of the cross-section. These discrete regions or phases of copper and iron are also of the same general shape and dimension. This degree of mixing and uniformity is ideal for bullet and projectile application.

This same powder mixture was also pressed and solid-state sintered into a second test button. Solid-state sintering implies the processing temperatures were maintained below the temperature of the lowest melting material. Consolidation, densification, and toughening occur due to diffusion processes. The powders used, and therefore the resulting phases, were on average 50-150 microns. The two test buttons, rapid-cooled, cast and solid-state sintered, showed comparable densities. Both samples had homogeneous microstructures with the primary difference being the relative scale, or size of the phases with the rapid-cooled, cast button retaining uniformity to features roughly an order of magnitude smaller than the sintered sample.

The two samples were ground on an abrasive disc to compare sparking behavior. The sintered sample showed visible sparking when put into contact with the spinning abrasive disc. These sparks were clearly visible in a lighted area. The cast part containing the desired microstructure as shown in FIG. 2 did not show any visible sparking under the same lighting conditions suggesting a notable improvement in this characteristic.

Our experiments demonstrate that a homogeneous microstructure containing fine copper and iron phases can be readily achieved via rapid cooling. Rapid-cooling of a molten metal mixture can be achieved by known atomization techniques to provide a powder suitable for pressing and sintering. Alternatively bullets or projectiles may also be produced by direct casting assuming sufficient cooling can be achieved to retain the desired fine-grain mixture throughout the cross-section of the part. The sparking tests we conducted also showed that the more intimately mixed, finer copper and iron phases greatly reduces or eliminates sparking that would otherwise occur when exiting the muzzle of a weapon or on metal targets or backstops.

In the preferred embodiment of this invention a combination of copper and iron raw materials containing 50 wt % of each element is melted and atomized to produce the desired alloy powder. This powder is then uniaxially pressed into the form of a bullet. This "green" or as-pressed form is then put through a heat-treatment in which the copper-iron powders sinter together resulting in a dense product suitable for use in ammunition. The processing temperatures employed are less than 1083° C. to avoid altering the desired copper-iron microstructure. To produce a frangible bullet an appropriate ceramic powder would be included in the powder blend prior to pressing.

Other methods of producing both frangible and non-frangible bullets or projectiles from the copper-iron alloys described in this invention can be used. As described above the only limit would be the maximum temperature of 1083° C. beyond which the beneficial attributes of the copper-iron alloy will be degraded.

Further embodiments of this invention are possible by adding chromium to the molten iron and copper alloy prior to rapid cooling. In general, chromium-to-iron weight ratios in the molten alloy ranging from 0 to 0.45 will form desired microstructures for making projectiles. It has been found that going beyond a chromium-to-iron weight ratio of 0.45 will increase cost without a commensurate gain in performance.

A preferred embodiment employs the use of recycled stainless steel, Type 410, which contains at least 11.5 wt % chromium for a chromium to iron weight ratio of roughly 0.13. This recycled material is commercially available at prices similar to that of pure iron making this approach economically viable. The performance benefits of adding chromium are also quite appealing by enhancing the corrosion resistance of the iron phase in the final, rapidly-cooled microstructure. By adding chromium to the alloy as described above both muzzle and on-target sparking are also further reduced.

Experiments were conducted in which copper and either Type 410 or Type 430 stainless steel, which contains at least 16 wt % Cr for a chromium to iron weight ratio of roughly 0.19, were melted to form a single phase, molten liquid and then rapidly cooled into a disc. Microscopy of cross-sections of these discs showed a fine-grained microstructure with uniformly distributed copper and iron phases. Additionally these discs were tested for sparking by contacting them with a spinning grinding disc. Both discs showed no visible sparks as would then be expected either exiting the muzzle of a weapon or when hitting a steel target.

REFERENCES

1) U.S. Pat. No. 8,028,026
2) "CRC Handbook of Chemistry and Physics", 70$^{th}$ Edition, Robert C. Weast, The Chemical Rubber Company Press, Inc., 1992.
3) "Mechanical Metallurgy, Principles and Applications", M. Meyers and K. Chawla, Prentice-Hall, Inc, 1984; pg. 433.

The invention claimed is:

1. A method of making a lead-free, corrosion-resistant projectile, comprising the steps of:

producing an iron-copper alloy by melting the metals together at a predetermined ratio of iron to copper;

adding chromium to the molten alloy;

rapidly quenching the molten alloy to produce a fine-grained microstructure with uniformly distributed copper and iron phases, wherein the iron and copper phases are in the range of 50 microns or less in any dimension; and shaping the alloy into a bullet-shaped form.

2. The method of claim 1, wherein the molten alloy prior to quenching has a chromium-to-iron weight ratio of 0.45 or less.

3. The method of claim 1, wherein the step of adding chromium to the molten alloy includes adding recycled stainless steel.

4. The method of claim 1, wherein the step of adding chromium to the molten alloy includes adding Type 410 or Type 430 stainless steel.

5. The method of claim 1, wherein:

the iron-copper alloy is rapidly quenched into a powder through atomization; and the atomization uses a rapidly moving gas, liquid stream, or via mechanical dispersion.

6. The method of claim 5, wherein:

the step of forming a bullet through solid-state sintering of the atomized powder; and heating at a temperature below 1083° C., the melting point of copper.

7. The method of claim 1, wherein the step of shaping the alloy into a bullet-shaped form includes casting.

8. The method of claim 1, wherein the step of shaping the alloy into a bullet-shaped form includes uniaxially pressing the alloy into a mold.

9. The method of claim 1, including the step of adjusting the ratio of iron to copper is adjusted to achieve a particular density or production cost.

10. The method of claim 1, wherein the ratio of iron to copper is 1:1 by weight.

11. The method of claim 1, including the step of combining a ceramic powder to the copper-iron alloy prior to forming to produce a frangible projectile.

12. The method of claim 1, including the step of adding one or more of the following in powder form to enhance strength, toughness, density, or hardness: tungsten, bismuth, uranium (depleted), nickel, chromium, manganese, boron, and silicon.

13. A projectile or bullet fabricated using the method of claim 1.

14. A projectile or bullet fabricated using the method of claim 2.

15. A projectile or bullet fabricated using the method of claim 3.

16. A projectile or bullet fabricated using the method of claim 4.

17. A projectile or bullet fabricated using the method of claim 5.

18. A projectile or bullet fabricated using the method of claim 6.

19. A projectile or bullet fabricated using the method of claim 7.

20. A projectile or bullet fabricated using the method of claim 8.

* * * * *